US008231801B2

(12) United States Patent
Guo et al.

(10) Patent No.: US 8,231,801 B2
(45) **Date of Patent: *Jul. 31, 2012**

(54) FIRE-EXTINGUISHING AEROSOL COMPOSITION FOR PRECISION ELECTRIC APPLIANCES

(75) Inventors: Hongbao Guo, Shaanxi (CN); Zanfeng Zhang, Shaanxi (CN)

(73) Assignee: Shaanxi J&R Fire Fighting Co., Ltd., Shaanxi (CN)

( * ) Notice: Subject to any disclaimer, the term of this patent is extended or adjusted under 35 U.S.C. 154(b) by 0 days.

This patent is subject to a terminal disclaimer.

(21) Appl. No.: 12/668,449

(22) PCT Filed: Nov. 14, 2007

(86) PCT No.: PCT/CN2007/003210

§ 371 (c)(1), (2), (4) Date: May 11, 2010

(87) PCT Pub. No.: WO2009/006765

PCT Pub. Date: Jan. 15, 2009

(65) Prior Publication Data

US 2010/0219366 A1 Sep. 2, 2010

(30) Foreign Application Priority Data

Jul. 10, 2007 (CN) ..... 2007 1 0018217

(51) Int. Cl.

| | |
|---|---|
| ***A62D 1/00*** | (2006.01) |
| ***C06B 31/00*** | (2006.01) |
| ***C06B 31/02*** | (2006.01) |
| ***D03D 23/00*** | (2006.01) |
| ***D03D 43/00*** | (2006.01) |

(52) U.S. Cl. ..... 252/5; 252/2; 149/45; 149/61; 149/108.2; 149/109.2

(58) Field of Classification Search ..... 252/2, 5; 149/45, 61, 108.2, 109.2

See application file for complete search history.

(56) References Cited

U.S. PATENT DOCUMENTS

| | | | | |
|---|---|---|---|---|
| 5,425,426 | A * | 6/1995 | Baratov et al. | 169/46 |
| 5,613,562 | A | 3/1997 | Galbraith et al. | |
| 6,024,889 | A * | 2/2000 | Holland et al. | 252/5 |
| 6,217,788 | B1 * | 4/2001 | Wucherer et al. | 252/5 |
| 2003/0097953 | A1 * | 5/2003 | Serizawa et al. | 102/531 |
| 2005/0242319 | A1 * | 11/2005 | Posson et al. | 252/2 |

FOREIGN PATENT DOCUMENTS

| | | |
|---|---|---|
| CN | 1386554 | * 12/2002 |
| CN | 1526461 | 9/2004 |
| CN | 1739820 | 3/2006 |
| EP | 976424 A * | 2/2000 |

* cited by examiner

*Primary Examiner* — Lorna M Douyon
*Assistant Examiner* — Tanisha Diggs
(74) *Attorney, Agent, or Firm* — Ladas & Parry LLP

(57) ABSTRACT

A fire-extinguishing aerosol for precision electric appliance is disclosed, which includes oxidant, flammable agent, adhesive and additive. The composition of the present invention is characterized in that the oxidant is the mixture of the potassium salt and the strontium salt, in which the content of the potassium salt oxidant is more than or equal to 5 mass % to less than 15 mass % of the total mass of the composition, and the content of the strontium salt oxidant is more than 52 mass % to less than or equal to 60 mass % of the total mass of the composition. In the fire-extinguishing aerosol composition of the present invention, the particle average diameter of all components is less than 50 μm. After quenching the fire in the space in which the precision electric appliance is installed, the fire-extinguishing aerosol composition of the present invention can ensure that the dielectric resistance of the precision electric appliance is more than or equal to 100 MΩ. The fire-extinguishing aerosol composition of the present invention is more reasonable than the prior art, friendly to the environment, and applicable to the precision electric appliance.

8 Claims, No Drawings

FIRE-EXTINGUISHING AEROSOL COMPOSITION FOR PRECISION ELECTRIC APPLIANCES

TECHNICAL FIELD OF THE INVENTION

This invention belongs to the technical field of fire-extinguishing compositions, and relates to a fire-extinguishing aerosol composition suitable for suppressing fire of types A and B in a relatively confined space, in particular to a fire-extinguishing aerosol composition suitable for precision electric appliances.

BACKGROUND OF THE INVENTION

The aerosol fire-extinguishing technology, which occurred since the 1990s, is a technology that extinguishes fire by damaging the combustion chain reaction of free radicals in the flame through the chemical reaction of an activity inhibitor produced based on the vigorous oxidation-reduction reaction between oxidant and fuel. Owing to its characteristics such as non-toxicity, non-corrosivity, high capacity efficiency, long storage period, total flooding and all-round fire-suppressing, said technology has attracted much attention. Over ten years since the end of the last century, the aerosol technology has been rapidly developed with continuous emergence of relevant patents. The aerosol fire-extinguishing technology can be mainly divided into the three types: hot aerosol fire-extinguishing technology, cold aerosol fire-extinguishing technology and water mist fire-extinguishing technology. The hot aerosol fire-extinguishing technology includes pyrotechnic composition-based hot aerosol fire-extinguishing technology and water-based hot aerosol fire-extinguishing technology. At present, the pyrotechnic composition-based hot aerosol fire-extinguishing technology, for the most part, refers to pyrotechnic composition-based fire extinguishers that are based on a solid substance composed of an oxidant, a flammable agent, an adhesive and a combustion rate regulating agent. As a substitute for Halon, the pyrotechnic composition-based hot aerosol fire extinguisher displays a high fire-extinguishing efficiency, the fire-extinguishing apparatus is simply structured without the need to use any pressure-proof container, the fire-extinguishing components can be combined modularly, and stored at normal temperature and pressure, the maintenance is convenient, the fire extinguisher can be stored for a long period of time, and has a low cost, with an ozone depletion potential ODP=0, and a relatively low global warming potential GWP, thus is obviously superior than other types of fire extinguishers with respect to the price/performance ratio, which helps to open up the market and advance the implementation of the Halon substitute plan.

In the prior art before the disclosure of the present invention, an alkali metal nitrate, in particular potassium nitrate, is preferably selected by the pyrotechnic composition-based hot aerosol fire-extinguishing technology in most cases as an oxidant for pyrotechnic composition-based hot aerosol fire-extinguishers in consideration of its capability to satisfy most requirements in the principle of component selection. For the prior art using a single component potassium nitrate as oxidant in fire-extinguishing aerosol compositions, the most frequently used is the hot aerosol fire-extinguishing technology represented by Russian series patent groups, such as RU2230726, RU2184587, RU2214848, RU2150310, RU2108124, RU2091106, RU2076761, RU2151135, RU2116095, RU2006239, RU2022589, and also patents/patent applications in other countries/regions such as WO0158530, WO9733653, WO9423800, U.S. Pat. No. 5,831,209, U.S. Pat. No. 6,042,664, U.S. Pat. No. 6,264,772, U.S. Pat. No. 5,573,555, U.S. Pat. No. 6,116,348; secondly, there are fire-extinguishing aerosol compositions that adopt a dual-component or multi-component oxidant, in which the main component is potassium nitrate and/or potassium perchlorate and/or the auxiliary component is nitrates, carbonates of other alkali metals, alkaline earth metals, for example described in patents/patent applications CA2250325, DE19915352, UA7773, EP0561035, WO2005023370, RU2157271, RU2098156, US20020121622, U.S. Pat. No. 5,423,385, U.S. Pat. No. 5,492,180, U.S. Pat. No. 5,425,426 and U.S. Pat. No. 6,277,296. As to the selection of flammable agent, a wide range of substances can meet the principle of component selection. In general, those qualified organic or inorganic flammable agents are selected under the condition that the design of negative oxygen balance can be satisfied, e.g. the flammable agents disclosed in such patents/patent applications as RU218458, RU2214848, US20010011567, U.S. Pat. No. 6,264,772, RU2157271, RU2050878, U.S. Pat. No. 5,831,209, WO9733653 and EP0561035. As the water-based hot aerosol fire-extinguishing technology, the oxidant and flammable agent are mostly selected from such components as ammonium nitrate, ammonium perchlorate, potassium nitrate, strontium nitrate, guanidine nitrate and the like, which are capable of generating gas, moisture and metallic solid particles, with the proviso that the high-oxygen balance design is satisfied, according to the content as disclosed in patents/patent applications such as U.S. Pat. No. 6,277,296, U.S. Pat. No. 6,093,269, U.S. Pat. No. 6,045,726, U.S. Pat. No. 6,019,861 and U.S. Pat. No. 5,613,562.

The above hot aerosol fire-extinguishing technologies are all featured by high efficiency in fire suppression, low cost and convenient maintenance, thus are becoming a prosperous and popular product in recent years. However, many problems gradually occur in the above prior arts and products along with the marketization of actual products and deep development of research and manufacture. Lots of recent application practice and research have shown that during the use of potassium nitrate as a single oxidant or as the main component in a multi-component oxidant to achieve high-efficient fire suppression, the produced strong-alkaline electroconductive substance potassium hydroxide would also bring about a second damage to the protected space and object. For the water-based hot aerosol fire-extinguisher, in particular, it is easier to form an strong-alkaline electroconductive substance between the produced moisture and the metal oxide, which shall usually lead to such irreparable consequences as damage or corrosion of the electric equipments after the fire is quenched in the instrument room, control room, generator room, battery box, communication base station and electrical transformer station. Moreover, the produced nitrous oxide may produce neurotoxicity to human if it cannot be decomposed rapidly. In view of said situation, some research departments and manufacturers have come up with hot aerosol fire-extinguishing technical solutions that can give consideration to both the fire suppression efficiency and the second damage problem. For example, the patent application CN200510105449 discloses a technical solution with respect to aerosol fire-extinguishers using strontium nitrate as the only oxidant, in which the greatest problem is that the fire-extinguishing efficiency of the fire-extinguishers is greatly reduced even though the second damage to the precision electric appliance is lessened to a certain extent. In U.S. Pat. No. 5,613,562 and U.S. Pat. No. 5,609,210, the fire-extinguishing compositions employ strontium nitrate as oxidant, whose main effect is to function as a power source to gasify a second fire-extinguishing liquid containing a carbon-fluorine bond and a carbon-hydrogen-fluorine bond and then eject it to the fire, but the produced hydrofluoric acid is not only hypertoxic but also highly corrosive, belonging to the water-based hot aerosol technology. For the U.S. Pat. No. 6,019,861, although the fire-extinguishing composition also contains potassium nitrate and strontium nitrate, said components are only added as additives or auxiliary oxidants and are primarily used for improving the quality of dilatable gas, and the main oxidant is ammonium nitrate that has to be phase stabilized in said fire-extinguishing technology, although it is advantageous for a relatively low temperature, the combustion and gas generation rates are both affected. The U.S. Pat. No. 6,093,269 provides a high oxygen balance pyrotechnic gas generating composition, wherein a high concentration of strontium nitrate is required to maintain a neutral balance of oxygen/fuel, primarily used in propellant compositions for automobiles, gun propellers, expansion devices, air bags.

Prior arts CN1739820A, CN1150952C and CN1222331C relate to similar subject matters to the present invention, in which CN1150952C and CN1222331C are prior patent applications filed by the inventors of the present application, but have the following shortcoming: they fail to separately design fire extinguishers according to the insulation required by different electric equipments, in order to give consideration both to fire-extinguishing efficiency and corrosion to electric equipments. This is because different types of electric equipments may exhibit different holding capability to the decrease of insulation resistance caused by electrostatic accumulation or acid-base corrosion at different risks. For example, for such heavy-current electric devices as generator, motor, high- and low-pressure electric appliances, electric fence, electric cable and the like, the insulation resistance is generally required to be from ≧1 MΩ to <20 MΩ (see Serial Electric Power Industry Standards of the People's Republic of China, for example DL/T5161.7-2002, *Specification for Construction Quality Checkout and Evaluation of Electric Equipment Installation* (*Quality Checkout of Electric Rotating Machine Construction*), etc.); for such ordinary electric equipments as communication, computer, automotive electric equipment and medical electric equipment, the insulation resistance is generally required to be from ≧20 MΩ to <100 MΩ (see *Electronics Industry Standards of the People's Republic of China* series, *Communication Industry Standards of the People's Republic of China* series, *Computer Industry Standards of the People's Republic of China* series, such as GB6649-86 *General Specification for Semiconductor Integrated Circuits*, IPC 9201 *Surface Insulation Resistance Handbook*, etc.); for precision electric appliances composed of printed circuit board, base plate and the like, the insulation resistance is generally required to be ≧100 MΩ (see *Electronics Industry Standards of the People's Republic of China* series, *Industry Standards for International Printed Circuits* series and the like, such as IPC-CC-830B *Handbook of Insulation Property and Quality of Printing Plate Assembled Appliances*, GB 4793 *Safety Requirements For Electronic Measuring Instruments*, GJB 1717-93 *General Specification for All-Purpose Printed Circuit Board Connectors*, etc.). Since different electric equipments have different requirements for the insulation resistance, the use of the same formulated fire-extinguishing composition for said electric equipments may be improper in terms of both the fire-extinguishing efficiency and investment cost. Thus, the components in the compositions and the contents thereof designed in the applications including the prior patent applications of the present invention are far from perfect, and certain technical characteristic parameters need to be improved. In the prior art before disclosure of the present invention, apart from the above technologies, there does not exist any special technology regarding fire-extinguishing aerosol compositions that are suitable for precision electric appliances without reducing fire-extinguishing efficiency.

CONTENT OF INVENTION

In order to solve the above-mentioned problems in the prior art, an object of the present invention is to provide a fire-extinguishing aerosol composition suitable for precision electric appliances, which is more reasonable and environment-friendly than the existing prior art.

Based on intensive studies of the hot aerosol fire-extinguishing technique in recent years, the inventors of the present application have found that the extinguishing concentration depends on the quality of the fire-extinguishing agent as well as the inherent physicochemical properties of the respective components per se. The combustion rate is further associated with such factors as the design of oxygen balance, and the selections of oxidant and flammable agent. In order to achieve the object of the invention, it is desirable to intensify the following aspects: (1) to design the fire-extinguishing capacity based on thorough consideration of ignitability, safety and chemical compatibility; (2) to adopt the incomplete potassium salt oxidant design under the principle of negative oxygen balance; (3) to simplify the components of the composition as much as possible, avoiding the production of unnecessary harmful substances.

After repeated screening for the oxidant, flammable agent, and tests in terms of the combustion reaction rate adjustment, the residual amount in fire-extinguishing aerosol, the cooling technique, the fire extinguisher micronization technique, the moisture absorption and insulation properties of solid particles, the inventors of the present application finally devises a fire-extinguishing aerosol composition that is suitable for precision electric appliances as technical solution of the present invention.

The present invention provides a fire-extinguishing aerosol composition suitable for precision electric appliances, which comprises an oxidant, a flammable agent, an adhesive and an additive, characterized in that the oxidant in the fire-extinguishing aerosol composition is a mixture of a potassium salt oxidant and a strontium salt oxidant; the flammable agent is one member or a combination of several members selected from the group consisting of guanidine nitrate, aminoguanidine nitrate, triaminoguanidine nitrate, and diaminoguanidine nitrate; the additive is one member or a combination of several members selected from the group consisting of aluminum powder, magnesium powder, carbon powder, magnesium carbonate, calcium carbonate and potassium feldspar; the adhesive is one member or a combination of several members selected from the group consisting of phenolic resin, epoxy resin and acrylic resin; and the content of each component in percent by mass in the fire-extinguishing composition is as follows:

| | |
|---|---|
| potassium salt oxidant: | more than or equal to 5% to less than 15%; |
| strontium salt oxidant: | more than or equal to 52% to less than or equal to 60%; |
| flammable agent: | 10% to 25%; |
| additive: | 2% to 20%; |
| adhesive: | 2% to 20%. |

DETAILED DESCRIPTION OF THE INVENTION

The strontium salt used in the fire-extinguishing composition of the present invention can be one member or a combination of 2-3 members selected from the group consisting of strontium nitrate, strontium oxide, strontium carbonate, strontium sulfite, strontium pyrophosphate, strontium bromide, strontium bichromate, strontium permanganate, strontium molybdate and strontium hexaboride; the potassium salt can be one member or a combination of 2-3 members selected from the group consisting of potassium nitrate, potassium chlorate, potassium perchlorate, potassium chloride, potassium carbonate and potassium citrate; the potassium salt oxidant can also be partially or wholly replaced by one member or a combination of 2-3 members selected from the group consisting of sodium bicarbonate, sodium nitrate, sodium perchlorate, ammonium nitrate, ammonium perchlorate, barium nitrate and cesium nitrate.

The flammable agent used in the fire-extinguishing composition of the present invention can further be one member or a combination of several members selected from the group consisting of pentaminotetrazole and a salt thereof, ditetrazole and a salt thereof, diazoaminotetrazole and a salt thereof, diazotetrazole dimer and a salt thereof.

The additive used in the fire-extinguishing composition of the present invention can further be one member or a combination of several members selected from the group consisting of potassium catechol borate and a salt thereof, hydroxybenzoic acid and a salt thereof, benzoic acid and a salt thereof, palmitic acid and a salt thereof, ammonium nitrate, potassium perchlorate, potassium chloride, copper oxide, iron oxide, copper phthalocyanine, potassium ferricyanide and hexamethylenetetramine.

The adhesive used in the fire-extinguishing composition of the present invention can further be one member or a combination of several members selected from the group consisting of polytetrafluoroethylene, ethylene polymer, nitrocellulose, glyceryl triacetate, polyvinyl acetate and melamine resin.

The maximum average diameter of particles of the oxidant, flammable agent, adhesive and additive in the fire-extinguishing composition of the present invention is within 50 μm.

According to one preferred embodiment of the present invention, the fire-extinguishing aerosol composition comprises:

| | |
|---|---|
| potassium nitrate: | 5%~14% |
| strontium nitrate: | 52%~60% |
| guanidine nitrate: | 10%~25% |
| aluminum powder: | 2%~10% |
| phenolic resin: | 2%~10%. |

According to another preferred embodiment of the present invention, the fire-extinguishing aerosol composition comprises:

| | |
|---|---|
| potassium perchlorate: | 5%~14% |
| strontium oxide: | 52%~60% |

-continued

| | |
|---|---|
| aminoguanidine nitrate: | 10%~25% |
| hexamethylenetetramine: | 2%~10% |
| epoxy resin: | 2%~10%. |

According to a further preferred embodiment of the present invention, the fire-extinguishing aerosol composition comprises:

| | |
|---|---|
| potassium carbonate: | 5%~14% |
| strontium pyrophosphate: | 52%~60% |
| pentaminotetrazole or a salt thereof: | 10%~25% |
| copper oxide: | 2%~10% |
| acrylic resin: | 2%~10%. |

According to a further preferred embodiment of the present invention, the fire-extinguishing aerosol composition comprises:

| | |
|---|---|
| potassium chlorate: | 5%~14% |
| strontium bichromate: | 52%~60% |
| diazoaminotetrazole or a salt thereof: | 10%~25% |
| copper phthalocyanine: | 2%~10% |
| epoxy resin: | 2%~10%. |

After using the fire-extinguishing aerosol composition of the present invention for suppressing fire in a space equipped with precision electric appliances, the insulation resistance of the precision electric appliances is more than 100 MΩ.

After repeated screening and trials of the components (the oxidant, flammable agent, adhesive and additive) and the proportions thereof, the inventors of the present application arrive at a technical solution with respect to a fire-extinguishing aerosol composition suitable for precision electric appliances. It has been proven through tests that the insulation resistance of the precision electric appliances after fire suppression is more than 100 MΩ in each case, which, compared with the prior art, not only achieves the object of preventing precision electric appliances from a second damage but also ensures the deserved efficiency of fire suppression, thus is a targeted new generation high-efficiency fire-extinguishing aerosol composition.

EXAMPLES

The present invention is described in more detail in the following with reference to examples, which shall by no means be interpreted as limitations thereon.

The fire-extinguishing aerosol composition suitable for precision electric appliances in the present invention is formulated according to the following table and the insulation resistance of the sediment is measured according to the following instructions:

| Name | Mass pecercentage of components/% | | | | | | | | | |
|---|---|---|---|---|---|---|---|---|---|---|
| of component | Ex. 1 | Ex. 2 | Ex. 3 | Ex. 4 | Ex. 5 | Ex. 6 | Ex. 7 | Ex. 8 | Ex. 9 | Ex. 10 |
| Potassium perchlorate | | 13 | | | | | | 14 | | |
| Potassium nitrate | 14 | | | | | | | | | 14 |
| Potassium carbonate | | | 14 | | | | | | | |
| Potassium chlorate | | | | 14 | | | | | | |
| Potassium citrate | | | | | | | 12 | | | |

-continued

| Name of component | Mass pecercentage of components/% | | | | | | | | | |
|---|---|---|---|---|---|---|---|---|---|---|
| | Ex. 1 | Ex. 2 | Ex. 3 | Ex. 4 | Ex. 5 | Ex. 6 | Ex. 7 | Ex. 8 | Ex. 9 | Ex. 10 |
| Sodium bicarbonate | | | | | | 10 | | | | |
| Barium nitrate | | | | | 12 | | | | | |
| Cesium nitrate | | | | | | | | | 14 | |
| Strontium nitrate | 53 | | | | | | | | | 52 |
| Strontium bichromate | | | | 56 | | | | | | |
| Strontium pyrophosphate | | | 54 | | | | | | | |
| Strontium oxide | | 56 | | | | | | | | |
| Strontium bromide | | | | | 58 | | | | | |
| Strontium hexaboride | | | | | | | | 56 | | |
| Strontium carbonate | | | | | | 60 | 58 | | 53 | |
| Guanidine nitrate | 24 | | | | 23 | | 22 | | | 25 |
| Aminoguanidine nitrate | | 22 | | | | | | | | |
| Pentaminotetrazole | | | 22 | | | 22 | | 24 | | |
| Diazoaminotetrazole | | | | 23 | | | | | 24 | |
| Aluminum powder | 5 | | | | | | | | 4 | |
| Benzoic acid | | | | | | | | | | |
| Copper phthalocyanine | | | | 3 | | | | | | |
| Hydroxybenzoic acid | | | | | | | | | | 4 |
| Iron oxide | | | | | 3 | | | | | |
| Copper oxide | | | 4 | | | 3 | | | | |
| Potassium ferricyanide | | | | | | | | 2 | | |
| Hexamethylenetetramine | | 5 | | | | | 4 | | 5 | |
| Acrylic resin | | | 6 | | | | | | | 5 |
| Polytetrafluoroethylene | | | | | 4 | | | 4 | | |
| Epoxy resin | | 4 | | 4 | | | 4 | | | |
| Phenolic resin | 4 | | | | | 5 | | | | |
| Sediment insulation resistance | >110 MΩ | >110 MΩ | >105 MΩ | >103 MΩ | >120 MΩ | >108 MΩ | >120 MΩ | >1200 MΩ | >110 MΩ | >100 MΩ |

Remarks:

1. Acrylic resin: Type 104 produced by Xi'an Resin Factory; polytetrafluoroethylene: particle-type produced by Sichuan Chengguang Factory; epoxy resin: Type E51 produced by Dalian Qihua Factory; phenolic resin, Type F-23 produced by Zhejiang Hangzhou Shunxiang.

2. Insulation resistance of the aerosol fire-extinguisher sediment is measured according to GB499.1-2007.10.2. The test equipment comprises a test chamber of $1M^3$(1×1×1 m), a megger with a measuring range from 0.1 MΩ to 500 MΩ (Type ZC36 megger manufactured by Shanghai Precision Instrument Factory), a petri dish, a precision balance and an aerosol generator.

3. The test board is a 100×100×1 mm white PVC test board. 100 g of the aerosol generating agent is pushed into a cartridge with a diameter of 40 mm and a height of 100 mm under a pressure of 5 Mpa by means of a press, an electric starter is installed, and then the cartridge is disposed into a minitype coolant-free generator.

4. In the test, the washed test board is picked up with tweezers and put into the petri dish, which is kept flat on the 250 mm-height test rack in the middle of the test chamber. The generator, with nozzle back to the test board, is placed at one corner of the test chamber, the starting line is connected, and then the test chamber door is shut. The timing by stop watch starts when the equipment is initiated. After 20 min, the petri dish loaded with the test board is removed and placed into a chamber with a constant temperature of 35° C. and a constant humidity of 90% for 30 min, the test board is removed and is immediately subject to resistance measurement.

The invention claimed is:

1. A fire-extinguishing aerosol composition suitable for precision electric appliances, which comprises an oxidant, a flammable agent, an adhesive and an additive, wherein after using said fire-extinguishing composition for suppressing fire in a space equipped with precision electric appliances, the insulation resistance of the precision electric appliances is more than or equal to 100MΩ; the oxidant in the fire-extinguishing aerosol composition is a mixture of a potassium salt oxidant and a strontium salt oxidant; said potassium salt oxidant is one member or a combination of several members selected from the group consisting of potassium chlorate, potassium chloride, and potassium citrate; said strontium salt oxidant is one member or a combination of several members selected from the group consisting of strontium nitrate, strontium oxide, strontium carbonate, strontium sulfite, strontium pyrophosphate, strontium permanganate, strontium bromide, strontium bichromate, strontium molybdate and strontium hexaboride; the flammable agent is one member or a combination of several members selected from the group consisting of guanidine nitrate, aminoguanidine nitrate, triaminoguanidine nitrate, and diaminoguanidine nitrate; the additive is one member or a combination of several members selected from the group consisting of aluminum powder, magnesium powder, carbon powder, magnesium carbonate, calcium carbonate and potassium feldspar; the adhesive is one member or a combination of several members selected from the group consisting of phenolic resin, epoxy resin and acrylic resin; and the content of each component in percent by mass in the fire-extinguishing aerosol composition is as follows:

| | |
|---|---|
| potassium salt oxidant: | more than or equal to 5% to less than 15%; |
| strontium salt oxidant: | more than 52% to less than or equal to 60%; |
| flammable agent: | 10% to 25%; |
| additive: | 2% to 20%; |
| adhesive: | 2% to 20%. |

2. The fire-extinguishing aerosol composition suitable for precision electric appliances according to claim 1, wherein said potassium salt oxidant further comprises one member or a combination of several members selected from the group consisting of sodium bicarbonate, sodium nitrate, sodium perchlorate, ammonium nitrate, ammonium perchlorate, barium nitrate and cesium nitrate.

3. The fire-extinguishing aerosol composition suitable for precision electric appliances according to claim 1, wherein said flammable agent further comprises one member or a combination of several members selected from the group consisting of pentaminotetrazole and a salt thereof, and ditetrazole and a salt thereof, diazoaminotetrazole and a salt thereof, diazotetrazole dimer and a salt thereof.

4. The fire-extinguishing aerosol composition suitable for precision electric appliances according to claim 3, wherein said additive further comprises one member or a combination of several members selected from the group consisting of potassium catechol borate and a salt thereof, hydroxybenzoic acid and a salt thereof, benzoic acid and a salt thereof, palmitic acid and a salt thereof, ammonium nitrate, potassium perchlorate, potassium chloride, copper oxide, iron oxide, copper phthalocyanine, potassium ferricyanide and hexamethylenetetramine.

5. The fire-extinguishing aerosol composition suitable for precision electric appliances according to claim 4, wherein said adhesive further comprises one member or a combination of several members selected from the group consisting of polytetrafluoroethylene, ethylene polymer, nitrocellulose, glyceryl triacetate, polyvinyl acetate and melamine resin.

6. The fire-extinguishing aerosol composition suitable for precision electric appliances according to claim 1, characterized in that the maximum average diameter of particles of said oxidant, flammable agent, adhesive and additive is within 50 μm.

7. The fire-extinguishing aerosol composition suitable for precision electric appliances according to claim 4, characterized in that said composition comprises:

| | |
|---|---|
| potassium perchlorate: | 5% to 14% |
| strontium oxide: | 52% to 60% |
| aminoguanidine nitrate: | 10% to 25% |
| hexamethylenetetramine: | 2% to 10% |
| epoxy resin: | 2% to 10%. |

8. The fire-extinguishing aerosol composition suitable for precision electric appliances according to claim 1, characterized in that said composition comprises:

| | |
|---|---|
| potassium chlorate: | 5% to 14% |
| strontium bichromate: | 52% to 60% |
| diazoaminotetrazole or a salt thereof: | 10% to 25% |
| copper phthalocyanine: | 2% to 10% |
| epoxy resin: | 2% to 10%. |

* * * * *